United States Patent [19]

Lemery

[11] 4,426,900

[45] Jan. 24, 1984

[54] SAW CHAIN USING AN IMPROVED SIDE CUTTER TOOTH

[75] Inventor: Douglas J. Lemery, Victoria, Canada

[73] Assignee: Kolve Sawchain Company, Gresham, Oreg.

[21] Appl. No.: 314,745

[22] Filed: Oct. 26, 1981

[51] Int. Cl.[3] ..... B27B 33/14

[52] U.S. Cl. ..... 83/833; 83/834

[58] Field of Search ..... 83/832, 833, 834

[56] References Cited

U.S. PATENT DOCUMENTS

| | | | |
|---|---|---|---|
| 834,251 | 10/1906 | Bailey | 83/831 X |
| 2,583,243 | 1/1952 | Tweedie | 83/832 X |
| 2,801,653 | 8/1957 | Van Wagner | 83/831 |
| 2,854,041 | 9/1958 | Siverson | 83/833 |
| 3,200,861 | 8/1965 | Merz | 29/455 X |
| 3,346,025 | 10/1967 | Anderson et al. | 83/833 |
| 3,543,817 | 12/1970 | Anderson | 83/833 |
| 3,745,870 | 7/1973 | Lemery | 83/833 |
| 3,977,288 | 8/1976 | Goldblatt et al. | 83/833 |

*Primary Examiner*—Frank T. Yost
*Attorney, Agent, or Firm*—Seed and Berry

[57] ABSTRACT

To provide better performance for a saw chain by enhancing the life and performance of side cutter teeth, this invention discloses a novel side cutter tooth which includes a cutter element having either a continuously curved portion attached to the body of the cutter tooth or a substantially straight portion extending outwardly from the body of the tooth. The continuously curved portion or substantially straight portion causes the cutter element to bend substantially at the intersection between the body and the cutter element when the cutter element is exposed to inwardly directed forces which tend to flatten the curved or substantially straight portion out of its half-space into the plane defined by the body of the cutter tooth. Removal of the complex curve ordinarily used in the center-mounted cutting teeth of saw chain greatly enhances the performance of the cutting teeth, reduces breakage of the teeth, and improves the efficiency of a saw chain using the improved cutting teeth.

14 Claims, 3 Drawing Figures

SAW CHAIN USING AN IMPROVED SIDE CUTTER TOOTH

DESCRIPTION

1. Technical Field

This invention relates to saw chains for chain saws. More particularly, this invention relates to a new and improved saw chain using a novel side cutter tooth.

2. Background Art

U.S. Pat. No. 3,745,870 disclosed a new and improved saw chain construction, including novel side cutter and raker teeth. The side cutter teeth could be easily formed and inexpensively manufactured. Flexible cutter elements permitted the tooth to flex laterally under cutting loads, thereby accommodating shocks from binding of the saw chain by forces directed inwardly upon the elements of the saw chain during cutting. The improved side cutter tooth included a cutter element which had a complex curvature. First (as shown in FIG. 4 of that patent), each element curved outwardly in a radius indicated by arrow 29. Second, each cutter element curved upwardly in a second radius indicated by arrow 31. Third, each cutter element extended in a substantially straight course from the second radius 31 upwardly at a constant angle to the tip 32. Due to this final, straight portion, the side cutter element bent at the second radius 31 when it experienced inwardly directed forces. These inwardly directed forces reduced the 7° angle of the element by moving the tip inwardly toward the centerline of the kerf. The forced lowered the relative position of the second radius 31 with respect to the first radius 29 and the body of the tooth, forming a crimp in the cutter element. Within a short time, the tooth would break at the crimp. Better performance is achieved by removing the complex bend fashioned in the side cutter teeth of U.S. Pat. No. 3,745,870, as will be further described.

DISCLOSURE OF INVENTION

An improved side cutter tooth, having about three times better performance and longer life than earlier developed teeth, has a cutter element that includes a continuously curved portion which is attached to the body of the side cutter tooth and which extends outwardly in a half-space adjacent the body to end in a cutter tip. The continuous curve of the cutter element causes the cutter element to bend substantially at the intersection of the body and the cutter element when the cutter element is exposed to inwardly directed forces (which tend to flatten the curved portion from the half-space into the plane of the body). In this way, crimping of the cutter element is substantially eliminated. The intersection between the body and the cutter element provides greater resistance to deforming and, therefore, ensures that the tooth will perform better and have a longer life than elements having a complex curvature. The cutter elements, however, still flex laterally under cutting loads to reduce binding of the saw chain and to promote better performance. Thus, the improved side cutter teeth retain the advantages disclosed in U.S. Pat. No. 3,745,870 and increase the cutting life of the teeth and saw chain.

Better performance for the side cutter teeth may also be achieved with a novel side cutter tooth having a substantially straight cutter element extending outwardly from the body. In this tooth, also, the area exposed to substantial bending stress will be the intersection of the cutter element and the body.

Saw chains for chain saws using the improved side cutter teeth of this invention perform better and require less maintenance due to reduction of breakage of the side cutter elements. A particularly desirable repeating sequence of cutter teeth is disclosed and claimed. This repeating series includes, in order, an improved side cutter tooth, a right-hand raker tooth, a second side cutter tooth, and a left-hand raker tooth.

BEST MODE FOR CARRYING OUT THE INVENTION

Figure 3:
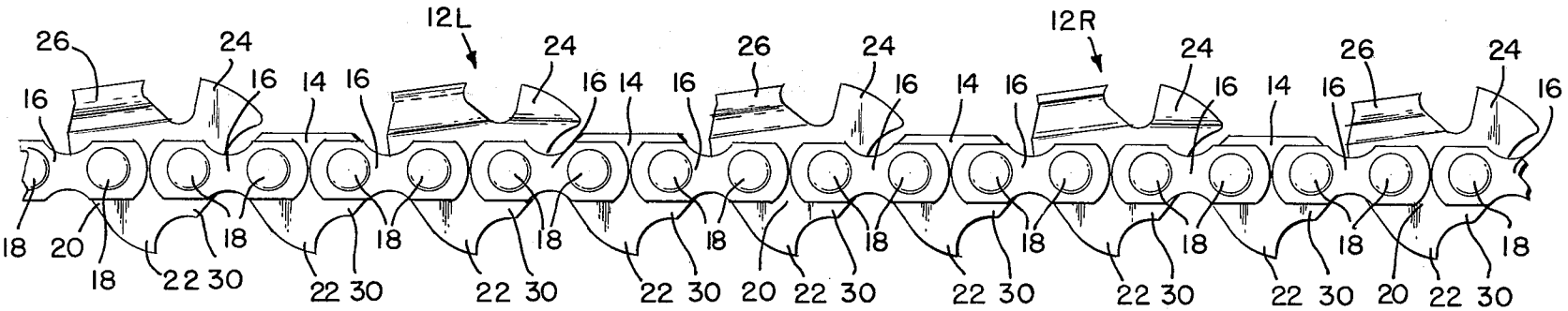
FIG. 3 is a side elevation of a preferred repeating series of cutter teeth in a saw chain using the side cutter teeth of FIG. 1.

FIG. 3 illustrates a repeating series of center-mounted cutting teeth, namely, side cutter teeth 10, right-hand raker teeth 12R, and left-hand raker teeth 12L. In a preferred chain, this repeating series continues, forming an endless belt of saw chain. Preferably, spacer links 14 separate the cutting teeth 10, 12R and 12L. The spacer links 14 engage the drive sprocket to help drive the saw chain and space the cutter teeth sufficiently far apart so that the teeth perform optimally. Side links 16 and rivets 18 join the spacer links 14 and cutting teeth 10, 12R, and 12L in end-to-end pivotal relationship in the well-known manner, with the bottom surfaces of the side links 16 providing a surface for supporting the saw chain on the rails of a bar (not shown). The side links 16 are positioned on opposite sides of the center-mounted cutting teeth 10, 12R, and 12L and spacer links 14. The side links 16 preferably are identical and interchangeable.

U.S. Pat. No. 3,745,870 is incorporated by reference into this patent application specification for its disclosure concerning saw chain and cutting teeth.

Figure 1:
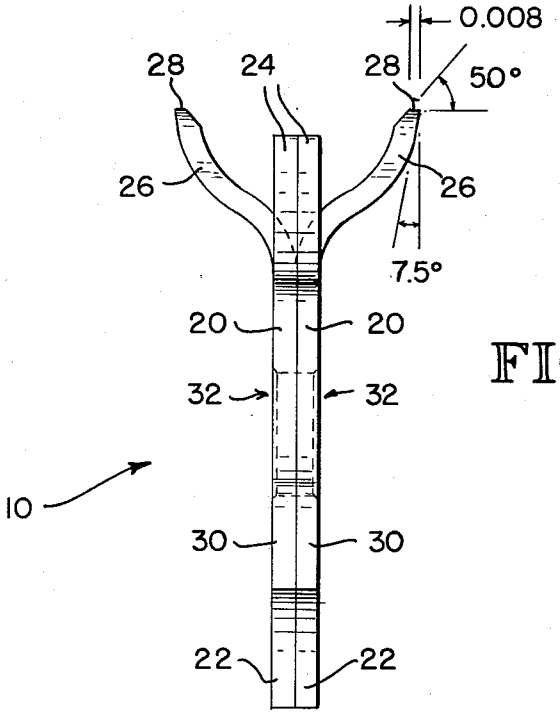
FIG. 1 is a front elevation of a preferred side cutter tooth of this invention.

One improved side cutter tooth 10 of this invention is illustrated in FIG. 1. The side cutter tooth 10 comprises a first and a second link which are mirror images of one another and which are positioned adjacent one another to form a generally U-shaped cutting tooth capable of simultaneously slitting both sides of the kerf when run as part of a saw chain. Each link has a body 20 including two rivet holes 32 for pivotal attachment of the tooth to the side links 16 and, subsequently, to the other cutting teeth or spacer links. A root 22 extends outwardly from each body 20 in the plane of the body and is capable of engaging a sprocket of the chain saw when the saw chain is moving around the bar of the chain saw. (Similarly, the spacer links 14 include roots 22.) A leading depth gauge 24 extends laterally outwardly from the body 20 in a direction substantially opposite the root 22 and in the plane of the body 20. As its name indicates, the depth gauge regulates the depth of cut scored by the cutter tooth 10. The right-hand raker tooth 12R and left-hand raker 12L also have analogous depth gauges 24, which commonly are offset from the centerline of the saw chain to provide more efficient performance. Offset depth gauges 24 better ensure that the raker teeth 12L and 12R run at the same depth in the kerf as the side cutter tooth 10, and chip wood chips of more constant thickness, thereby improving the overall performance of the saw chain and chain saw. The value of offset depth gauges is more completely disclosed in a copending U.S. patent application Ser. No. 314,746 to Mr. Lemery entitled "IMPROVED SAW CHAIN."

A trailing cutter element 26 extends laterally outwardly from the body 20 in a direction substantially opposite the root 22, yet is spaced somewhat behind the depth gauge 24. As best illustrated in FIG. 1, the trailing cutter element 26 includes a continuously curved portion which is attached to the body 20 and which extends in a simple arc outwardly to a cutter tip 28. Thus, the continuously curved portion curls out of the plane defined by the body 20 into one of half-spaces defined by the plane. Analogously, the cutter element 26 of the adjacent, mirror-image link of the side cutter tooth extends outwardly in an arc into the other half-space defined by the plane. FIG. 1 illustrates that the cutter tip 28 has a steeply angled internal bevel (preferably at 50° to the horizontal) and a narrow planar end to do the slitting and scoring. The angle from the vertical changes steadily along the continuous curve of the cutter element 26 rather than extending substantially at a constant angle (as illustrated in FIG. 4 of U.S. Pat. No. 3,745,870). The continuous curve forces the cutter element 26 to bend, if at all, substantially at the intersection of the body 20 and the cutter element 26 when the cutter element 26 is exposed to inwardly directed forces that tend to flatten the curved portion of the cutter element 26 from its half-space into the plane defined by the body 20. No longer does the cutter element 26 crimp (plastically deform) at a curve of the cutter element displaced from the body of the element, as commonly occurred in the side cutter teeth of U.S. Pat. No. 3,745,870. The intersection of the cutter element 26 with the body 20 provides greater resistance to crimping of the cutter element 26, while it does not significantly hinder the flexing of the cutter element 26 during normal operation of the tooth 10 and saw chain.

For purposes of this description, "continuous curve" shall mean an arc of a circle of predetermined radius. A "continuous curve" curves concavely upwardly from the intersection of the body and curved portion of the link over the entire distance between the body and the cutter tip.

Preferably, each link of the side cutter tooth 10 includes a spur 30 which extends laterally outwardly from the body 20 substantially in the same direction as the root 22, yet spaced somewhat ahead of the root 22 in the same plane as the root 22. As more completely described in Mr. Lemery's copending U.S. patent application Ser. No. 321,403 now U.S. Pat. No. 4,387,615 entitled "An Anti-Kick Saw Chain and a Kick-Reducing Method," the spur 30 is a general thickening of the body 20 of the cutting tooth to allow the tooth to cock when the tooth engages an idler sprocket on the end of the bar of a chain saw. When the tooth moves in an arc around the bar, the relative distance between the leading depth gauge 24 and the trailing cutter element (in this case, 26) is substantially no greater than the distance between the leading depth gauge 24 and the trailing cutter element 26 when the saw chain is moving in a straight line along the bar. Cocking of the cutting teeth as they pass around the outer end bar greatly reduces the possibility of encountering a kick by the saw chain and chain saw.

Figure 2:
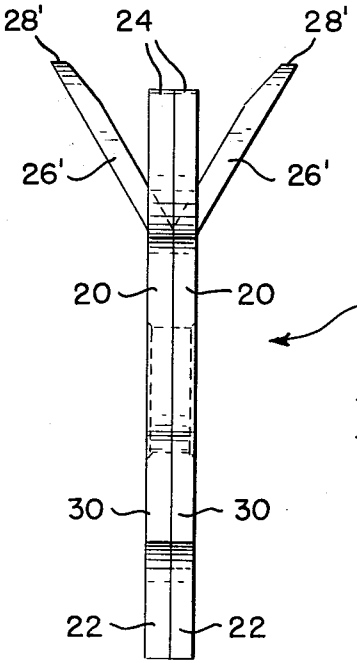
FIG. 2 is a front elevation of an another preferred side cutter tooth of this invention.

As illustrated in FIG. 2, an alternate embodiment of the side cutter tooth 10' which this invention includes a trailing cutter element 26' which extends laterally outwardly from the body 20 in a direction substantially opposite the root 22. The cutter element 26 includes a substantially straight portion attached to the body 20. The substantially straight portion ends in a cutter tip 28' as shown. Like the continuously curved cutter element 26, the substantially straight cutter element 26' extends outwardly from the body 20 in one half-space defined by the plane of the body 20. The substantially straight portion of the cutter element 26' ensures that the cutter element 26' bends substantially at the intersection between the cutter element 26' and the body 20 when the cutter element 26' is exposed to inwardly directed forces which tend to flatten the straight portion of the cutter element 26' out of the half-space into which it extends and into the plane of the body 20.

A saw chain including a repeating series of cutter teeth is illustrated in FIG. 3. Preferably, an improved side cutter tooth 10 leads a right-hand raker tooth 12R. The right-hand raker tooth 12R leads a second side cutter tooth 10, which in turn leads a left-hand raker tooth 12L. The alternating chipping and scoring of the kerf improves performance and efficiency of the preferred saw chain of this invention.

While preferred embodiments of this invention have been illustrated and described, the invention is capable of modification and addition without departing from its basic principles. Accordingly, the invention is not intended to be limited to the exact embodiment illustrated, which are presented only as examples. The scope of the invention should be determined by reference to the claims interpreted in light of the prior art.

I claim:

1. An improved side cutter tooth for a saw chain of a chain saw, comprising:

(a) a first link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane; and (iv) a trailing cutter element of flexible metal allowing the element to flex outwardly under normal cutting loads so that the cutting width of the link is at least as great as the cutting width of raker teeth in the saw chain, the element extending laterally outwardly from the body in a direction substantially opposite the root, yet spaced behind the depth gauge, including a continuously curved portion attached to the body and ending in a cutter tip, the portion curling out of the plane into one half-space, wherein the continuous curve causes the cutter element to bend substantially at the intersection of the body and the cutter element when the cutter element is exposed to inwardly directed forces which tend to flatten the curved portion from the half-space into the plane, thereby reducing crimping and breakage of the cutter element; and (b) a second link having a cutter element of flexible metal allowing the element to flex outwardly under normal cutting loads as with the first link, the second link being substantially a mirror image of the first link, positioned adjacent the first link in substantial alignment with the first link to form a side cutter tooth capable of simultaneously cutting slits on both sides of a kerf when moving as part of a saw chain.

2. The side cutter tooth of claim 1 wherein the links further have a spur extending laterally outwardly from the body substantially in the same direction as the root, yet spaced ahead of the root, in the plane, being capable of cocking the side cutter tooth by engaging an idler sprocket on the end of the bar of a chain saw so that, when the side cutter tooth moves in an arc around the end of the bar, the relative distance between the leading depth gauge and the trailing cutter element is substantially no greater than the distance between the leading depth gauge and the trailing cutter element when the saw chain is moving in a straight line.

3. An improved side cutter tooth for the saw chain of a chain saw, comprising:

a first link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane; and (iv) a trailing cutter element of flexible metal allowing the element to flex outwardly under normal cutting loads, so that the cutting width of the link is at least as great as the cutting width of raker teeth in the saw chain, the element extending laterally outwardly from the body in a direction substantially opposite the root, yet spaced behind the depth gauge, including a straight portion attached to the body and ending in a cutter tip, the portion extending outwardly from the body into one half-space, wherein the cutter element bends substantially at the intersection of the cutter element and body when the cutter element is exposed to inwardly directed forces which tend to flatten the straight portion from the half-space into the plane, thereby reducing crimping and breakage of the cutter element; and (b) a second link, having a cutter element of flexible metal allowing the element to flex outwardly under normal cutting loads as with the first link, the second link being substantially a mirror image of the first link, positioned adjacent the first link in substantial alignment with the first link to form a side cutter tooth capable of simultaneously cutting slits on both sides of a kerf when moving as part of a saw chain.

4. An improved saw chain for a chain sw, capable of cutting a kerf, comprising a plurality of pivotally joined teeth forming an endless belt of saw chain and including at least one improved side cutter tooth in the belt, wherein the side cutter tooth is made from flexible metal to allow the tooth to flex outwardly under normal cutting loads so that the cutting width of the side cutter tooth is at least as great as the width of the raker teeth and wherein the tooth comprises:

(a) a first link having (i) a body defining a plane for the tooth and two half-spaces separated by the plane;

(ii) a root, extending from the body in the plane, capable of engaging a sprocket of the chain saw;

(iii) a leading depth gauge extending laterally outwardly from the body in a direction substantially opposite the root but in the plane; and (iv) a trailing cutter element extending laterally outwardly from the body in a direction substantially opposite the root, yet spaced behind the depth gauge, including a continuously curved portion attached to the body and ending in a cutter tip, the portion curling out of the plane into one half-space, wherein the continuous curve causes the cutter element to bend substantially at the intersection of the body and the cutter element when the cutter element is exposed to inwardly directed forces which tend to flatten the curved portion from the half-space into the plane, thereby reducing crimping and breakage of the cutter element; and (b) a second link, being substantially a mirror image of the first link, and being flexible like the first link, positioned adjacent the first link in substantial alignment with the first link to form a side cutter tooth capable of simultaneously cutting slits on both sides of a kerf when moving as part of a saw chain.

5. The saw chain of claim 4 wherein the side cutter tooth further includes on each link a spur extending laterally outwardly from the body substantially in the same direction as the root, yet spaced ahead of the root, in the plane, being capable of cocking the side cutter tooth by engaging an idler sprocket on the end of the bar of a chain saw so that, when the side cutter tooth moves in an arc around the end of the bar, the relative distance between the leading depth gauge and the trailing cutter element is substantially no greater than the distance between the leading depth gauge and the trailing cutter element when the saw chain is moving in a straight line.

6. An improved saw chain for a chain saw as defined in claim 4, further including at least one raker tooth traveling behind the side cutter tooth to chip wood from the scored kerf.

7. The improved saw chain of claim 6 wherein the side cutter tooth has links having a spur extending laterally outwardly from the body substantially in the same direction as the root, yet spaced ahead of the root, in the plane, being capable of cocking the side cutter tooth by engaging an idler sprocket on the end of the bar of a chain saw so that when the side cutter tooth moves in an arc around the end of the bar, the relative distance between the leading depth gauge and the trailing cutter element is substantially no greater than the distance between the leading depth gauge and the trailing cutter element when the saw chain is moving in a straight line.

8. The improved saw chain of claim 7 wherein the raker tooth includes an offest depth gauge to provide improved performance for the saw chain.

9. An improved saw chain as defined in claim 4, the teeth being joined in a repeating series, wherein each series includes a side cutter tooth, a right-hand raker tooth, and a left-hand raker tooth.

10. The saw chain of claim 9 wherein each series includes, in order, as cutting teeth: a first side cutter tooth, a right-hand raker tooth, a second side cutter tooth, and a left-hand raker tooth.

11. The saw chain of claim 9 or 10 wherein the raker teeth include offset depth gauges to provide improved performance for the saw chain.

12. The saw chain of claim 9 wherein each cutting tooth is separated from the next cutting tooth by a spacer link.

13. The improved saw chain of claim 9 wherein the side cutter tooth has links having a spur extending laterally outwardly from the body substantially in the same direction as the root, yet spaced ahead of the root, in the plane, being capable of cocking the side cutter tooth by engaging an idler sprocket on the end of the bar of a chain saw so that when the side cutter tooth moves in an arc around the end of the bar, the relative distance between the leading depth gauge and the trailing cutter element is substantially no greater than the distance between the leading depth gauge and the trailing cutter element when the saw chain is moving in a straight line.

14. The improved saw chain of claim 13 wherein each raker tooth has an off-set depth gauge to control the thickness of chips cut so that the saw chain has improved performance.

* * * * *